US010532571B2

(12) United States Patent
Chen et al.

(10) Patent No.: US 10,532,571 B2
(45) Date of Patent: Jan. 14, 2020

(54) PRINTHEAD STRUCTURE

(71) Applicant: HEWLETT-PACKARD DEVELOPMENT COMPANY, L.P., Houston, TX (US)

(72) Inventors: Zhizhang Chen, Corvallis, OR (US); James Elmer Abbott, Jr., Corvallis, OR (US); Michael W Cumbie, Albany, NY (US); Roberto A Pugliese, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/544,999

(22) PCT Filed: Mar. 12, 2015

(86) PCT No.: PCT/US2015/020146
§ 371 (c)(1),
(2) Date: Jul. 20, 2017

(87) PCT Pub. No.: WO2016/144359
PCT Pub. Date: Sep. 15, 2016

(65) Prior Publication Data

US 2018/0001636 A1 Jan. 4, 2018

(51) Int. Cl.
*B41J 2/14* (2006.01)
*B41J 2/16* (2006.01)

(52) U.S. Cl.
CPC ..... *B41J 2/14129* (2013.01); *B41J 2/14024* (2013.01); *B41J 2/1642* (2013.01); *B41J 2/1646* (2013.01)

(58) Field of Classification Search
CPC .. B41J 2/14129; B41J 2/21402; B41J 2/1646; B41J 2/1603; B41J 2/1642
See application file for complete search history.

(56) References Cited

U.S. PATENT DOCUMENTS

| | | | | |
|---|---|---|---|---|
| 6,267,471 | B1 * | 7/2001 | Ramaswami | B41J 2/14129 347/63 |
| 7,025,894 | B2 | 4/2006 | Hess et al. | |
| 7,382,421 | B2 | 6/2008 | Hoffman et al. | |
| 8,567,909 | B2 | 10/2013 | Sieber | |
| 2004/0070649 | A1 | 4/2004 | Hess et al. | |
| 2005/0233159 | A1 * | 10/2005 | Fartash | B41J 2/14129 428/457 |
| 2008/0259131 | A1 | 10/2008 | Cornell et al. | |
| 2011/0310183 | A1 | 12/2011 | Tamaru et al. | |
| 2013/0162724 | A1 | 6/2013 | Pugliese, Jr. et al. | |

(Continued)

FOREIGN PATENT DOCUMENTS

WO WO-2015005934 1/2015

OTHER PUBLICATIONS

Muralt, Paul; "Recent Progress in Materials Issues for Piezoelectric MEMS"; Journal of the American Ceramic Society; 2008; vol. 91, No. 5, pp. 1385-1396.

*Primary Examiner* — Sharon A. Polk
(74) *Attorney, Agent, or Firm* — HP Inc. Patent Department

(57) ABSTRACT

In one example, a printhead structure includes an ejector element, a multi-layer insulator covering the ejector element, and an amorphous metal on the insulator.

16 Claims, 3 Drawing Sheets

(56) References Cited

U.S. PATENT DOCUMENTS

| | | | | |
|---|---|---|---|---|
| 2014/0021472 | A1 | 1/2014 | Hahn et al. | |
| 2014/0340450 | A1 | 11/2014 | Kunnavakkam et al. | |
| 2016/0075136 | A1* | 3/2016 | Abbott, Jr. ..... | B41J 2/14129 347/62 |

* cited by examiner

PRINTHEAD STRUCTURE

BACKGROUND

In some inkjet type dispensers, resistors heat ink and other liquids to eject drops of the liquid from tiny dispensing chambers toward a target. An inkjet printhead may include hundreds or thousands of resistors. Resistors are turned on and off selectively to dispense drops of liquid on to (or in to) the target as desired, for example to form a printed image on a sheet of paper. The resistors are usually covered by a tough material that protects the resistors from the harsh environment inside the dispensing chambers. These protective coverings are commonly referred to as "passivation" structures.

BRIEF DESCRIPTION OF THE DRAWINGS

The same part numbers designate the same or similar parts throughout the figures. The figures are not necessarily to scale.

DETAILED DESCRIPTION

Figure 1:
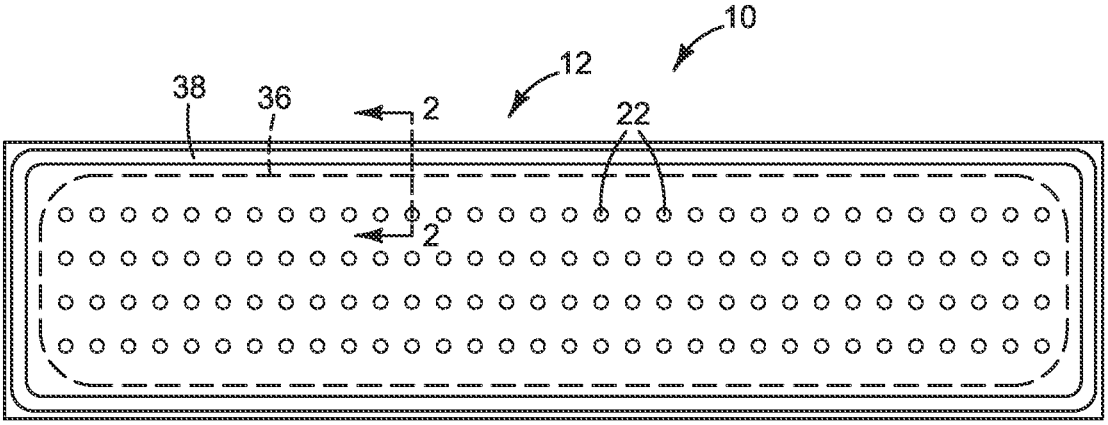
FIGS. 1 and 2 are plan and section views, respectively, illustrating a printhead implementing one example of a printhead structure.

Passivation structures that protect resistors or other ejector elements in an inkjet printhead can have a significant impact on power efficiency, reliability, and cost. Thinner passivation structures are usually desirable to improve power efficiency. However, it remains a difficult challenge to form very thin, robust and reliable passivation structures cost effectively, particularly for longer, thinner printhead dies being developed for use in media wide inkjet printers.

Tantalum is commonly used as a chamber lining for passivation structures in inkjet printheads because it is chemically resistant to many inks and mechanically resistant to cavitation forces. Currently, tantalum linings in printhead dispensing chambers are deposited in polycrystalline form, which leads to grain boundaries and an intrinsically rough surface. Oxide growth in crystalline materials usually follows these grain boundaries, and consumption by oxidation is one failure mode of a polycrystalline tantalum layer in a passivation structure. In addition, grain boundaries can promote crack propagation and limit mechanical robustness. International patent application no. PCT/US2013/050203 filed 12 Jul. 2013 by Hewlett-Packard Development Company describes an amorphous metal lining developed to improve printhead passivation. Continued development has shown that the amorphous metals described in the '203 application can be used with a multi-layer insulator to further improve printhead passivation.

A new printhead structure has been developed that combines an amorphous metal with multiple insulators to shrink the overall thickness of the passivation structure while still providing robust and reliable passivation of the ejector elements, even on longer, thinner printheads. In one example, a printhead structure includes a resistor or other ejector element, a multi-layer insulator covering the ejector element, and an amorphous metal on the insulator. In one example, the passivation stack includes exactly three layers: a first, thicker insulator covering the ejector element and formed by PECVD (plasma enhance chemical vapor deposition); a second, thinner insulator on the first insulator and formed by ALD (atomic layer deposition); and an amorphous metal layer on the ALD insulator.

Printhead power efficiency may be improved by combining an ALD insulator with an amorphous metal to help thin the passivation structure. Combining a pinhole free ALD insulator that exhibits good step coverage with a stable and mechanically robust amorphous metal helps make thinner passivation possible. For example, a 550 nm three layer stack used currently (300 nm polycrystalline metal on 250 nm two layer PECVD insulator) can be replaced by a new 250 nm three layer stack (100 nm amorphous metal on 20 nm ALD insulator on 130 nm PECVD insulator) to improve printhead power efficiency while preserving robust passivation. The amorphous metal is stable, free of grain boundaries and presents an atomically smooth interface to provide a mechanical robust and fatigue resistant for a suitably tough, reliable lining inside the dispensing chambers to protect the underlying insulators and the ejector elements against cavitation damage.

While it may be possible to utilize a single insulating layer and still achieve good passivation, it is expected that a multi-layer insulator will be desirable in many printhead implementations for both strength and versatility. For example, an underlying PECVD layer adds strength to help protect against cracking in an ALD thin layer. Also, a silicon nitride PECVD layer increases breakdown voltage across the stack and integrates well with other parts of the printhead, for example, as an adhesive layer securing a nozzle plate or other fluidic structure.

These and other examples shown in the figures and described herein illustrate but do not limit the scope of the patent, which is defined in the Claims following this Description.

Passivation insulators are often referred to as "dielectrics" because they are commonly formed with dielectric materials even though they function as an electrical insulator in the passivation structure. Also, a dielectric layer that functions as an insulator in a passivation structure may function as a dielectric in other parts of a printhead. Accordingly, in this document reference to an "insulator" in a passivation structure does not preclude the material or layer of material from functioning as a dielectric in other parts of a printhead.

As used in this document, a "liquid" means a fluid not composed primarily of gases; a "printhead" means that part of an inkjet type dispenser to dispense liquid from one or more openings, for example as drops or streams. A printhead is not limited to printing with ink but also includes inkjet type dispensing of other liquids and/or for uses other than printing. A "printhead structure" may include structures formed or used during manufacturing or assembly of a printhead, as well structures in a fully manufactured and assembled printhead.

Figure 2:
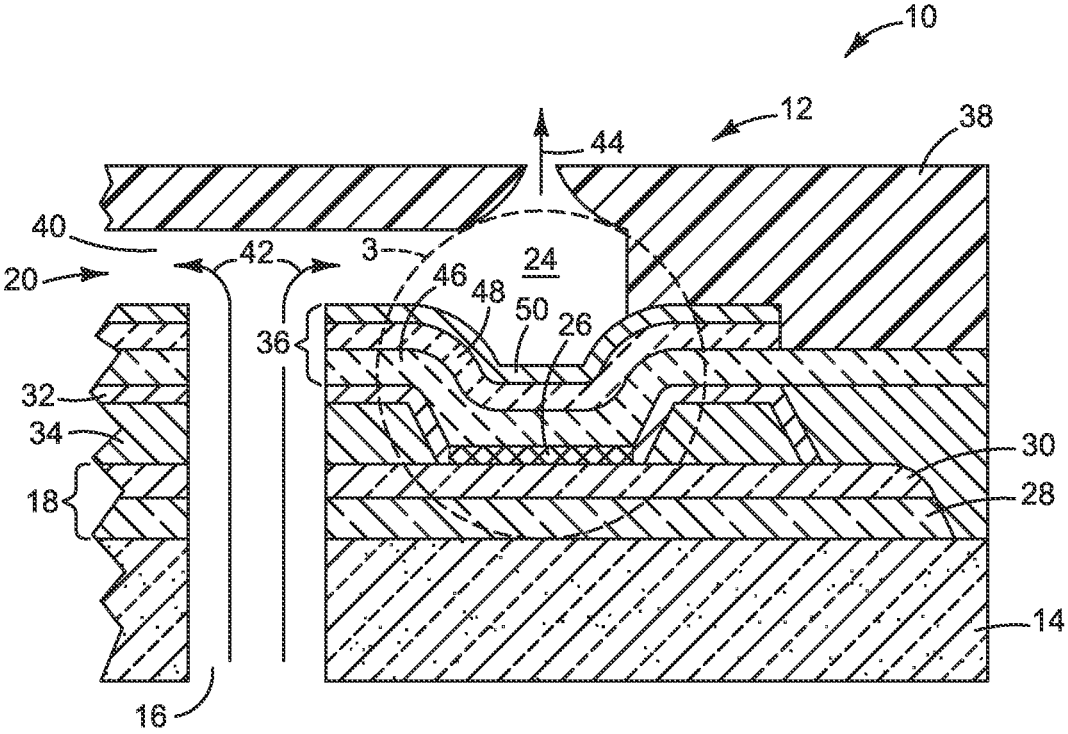
Figure 3:
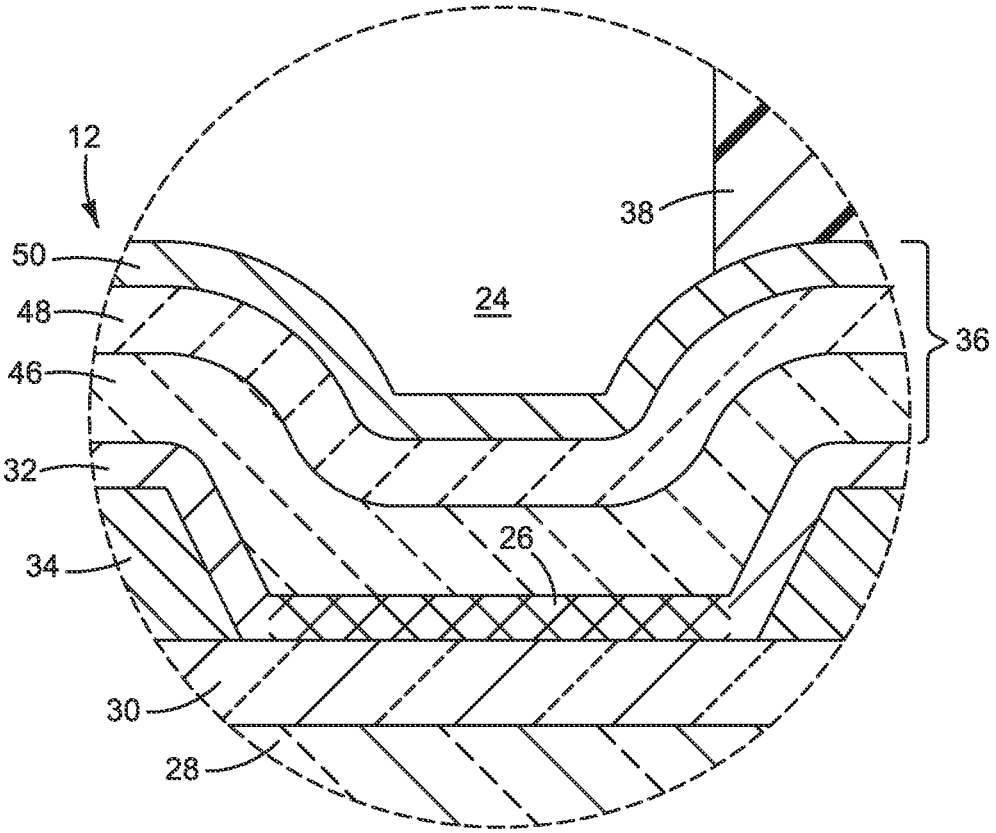
FIG. 3 is a detail from FIG. 2.

FIGS. 1 and 2 are plan and section views, respectively, illustrating a printhead 10 implementing one example of a new printhead structure 12. FIG. 3 is a detail from FIG. 2. Referring to FIGS. 1-3, printhead 10 is formed in part in a layered architecture that includes a silicon or other suitable substrate 14, a slot 16 formed in substrate 14, and various conductive, insulating and dielectric layers. Referring specifically to FIGS. 2 and 3, printhead 10 includes a dielectric 18 formed on substrate 14 and printing fluid dispensers 20 formed over dielectric 18. (Only one dispenser 20 is shown in FIG. 2.) For a thermal inkjet printhead 10, each dispenser 20 is configured as a drop generator that includes a nozzle 22, a dispensing chamber 24, and a resistor 26 to force liquid in chamber 24 out through nozzle 22. In the example shown, dielectric 18 is a patterned stack that includes two layers formed on substrate 14—a TEOS (tetraethyl orthosilicate) layer 28 and a BPSG (borophosphosilicate glass) layer 30 overlaying TEOS layer 28. Other materials may be suitable for dielectric 18, such as undoped silicate glass (USG), silicon carbide or silicon nitride.

Each resistor 26 is formed in a resistive layer 32 over dielectric 18. A resistive layer 32 may be made, for example, of tungsten silicide nitride (WSiN), tantalum silicide nitride (TaSiN), tantalum aluminum (TaAl), tantalum nitride (Ta2N), or combinations of these materials. A conductive metal layer 34 formed in contact with resistive layer 32 may be used to supply current to resistors 26 and/or to couple resistors 26 to a control circuit or other electronic circuits in printhead 10. A conductive layer 34 may be made, for example, of platinum (Pt), aluminum (Al), tungsten (W), titanium (Ti), molybdenum (Mo), palladium (Pd), tantalum (Ta), nickel (Ni), or combinations of these materials.

A multi-layer protective structure 36 covers resistor 26 as a barrier against cavitation (in chamber 24), oxidation, corrosion, and other environmental conditions. Protecting resistors 26 and other sensitive elements in a printhead 10 from environmental degradation is commonly referred to as passivation. Thus, protective cover 36 is also referred to herein as a passivation structure 36. Nozzles 22 are formed in a nozzle plate 38 formed on or affixed to the underlying structure. Nozzle plate 38 helps define dispensing chamber 24 and fluid channels 40 that carry liquids from slot 16 to chamber 24. In operation, liquid feeds into chamber 24 through slot 16 and channel 40, as indicated by flow arrows 42 in FIG. 2. A resistor 26 is energized to heat the liquid in chamber 24 to create a bubble that forces liquid out of nozzle 22 to form a drop that is propelled toward a target, as indicated by flow arrow 44 in FIG. 2.

While printhead 10 faces up in FIGS. 1-3, a printhead 10 installed in a printer or other dispenser usually faces down so that drops are dispensed down to the target. Words that imply orientation, such as "cover", "over" and "on", are meant with respect to the orientation of the printhead structure shown in the figures. Also, printhead 10 shown in FIGS. 1-3 is just one example of a printhead in which examples of a printhead structure 12 could be implemented. Other printheads with other or different features from those shown are possible.

In the example shown in FIGS. 1-3, passivation structure 36 includes multiple insulator layers 46, 48 and an amorphous metal layer 50 lining that part of dispensing chamber 24 over resistor 26. Insulator layers 46, 48, also called passivation layers 46, 48, insulate resistor 26 and other underlying conductive structures from metal lining 50 as well as help protect those structures from the harsh environmental conditions inside chamber 24. The power to drive resistor 26 to heat liquid in chamber 24, commonly referred to as "turn on energy", is related to the thickness of the structure. A thinner passivation structure 36 usually means a lower turn on energy and less power is consumed driving resistor 26.

For example, a three layer stack has been developed that utilizes a silicon nitride first layer 46, a hafnium oxide second layer 48 on first insulator layer 46, and a tantalum/tungsten/silicon amorphous metal alloy third layer 50 on second insulator layer 48. In one example, silicon nitride layer 46 is formed to a thickness of about 130 nm by PECVD, hafnium oxide second layer 48 is formed to a thickness of about 20 nm by ALD, and amorphous metal layer 50 is formed to a thickness of about 100 nm, for a total stack thickness of about 250 nm. Modeling of this stack shows an approximate 25% reduction in turn-on-energy compared to a 550 nm three layer stack of polycrystalline tantalum (300 nm) on PECVD silicon carbide (83 nm) on PECVD silicon nitride (167 nm) currently in use.

Other suitable combinations of materials and thicknesses are possible. Insulators that may be suitable for use in passivation structure 36 include silicon oxides and nitrides for a PECVD layer 46 and nitrides and oxides of aluminum, silicon, hafnium, zirconium and tantalum for an ALD layer 48. While other techniques may be used to form insulator layer 46, it is expected that the use of PECVD will be desirable in many implementations to improve strength and versatility. Also, while other techniques may be used to form insulator layer 48, it is expected that the use of ALD will be desirable in many implementations for pinhole free layering with good step coverage. An ALD layer of hafnium oxide in particular provides higher chemical robustness and breakdown voltage compared to a PECVD layer of silicon carbide. Using current PECVD and ALD deposition techniques, it is expected that a multi-layer insulator 50-150 nm thick (layers 46, 48 in this example) is feasible and effective for robust passivation when combined with a 50-100 nm thick amorphous metal layer 50 (with second layer 48 in the range of 5-20 nm).

Figure 4:
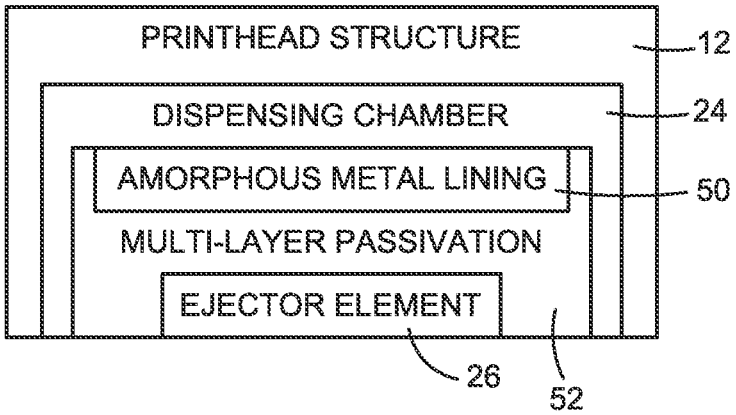
FIG. 4 illustrates another example of a printhead structure.

In another example, shown in FIG. 4, a printhead structure 12 includes multiple passivation layers 52 covering an ejector element 26 and an amorphous metal layer 50 layer lining part of dispensing chamber 24 on an outermost passivation layer. Multi-layer passivation layers 52 may include, for example, insulator layers 46 and 48 shown in FIGS. 2 and 3.

In one example, an amorphous metal layer 50 includes from 5 atomic % to 90 atomic % of a metalloid of carbon, silicon, or boron; from 5 atomic % to 90 atomic % of a first metal of titanium, vanadium, chromium, cobalt, nickel, zirconium, niobium, molybdenum, rhodium, palladium, hafnium, tantalum, tungsten, iridium, or platinum; and from 5 atomic % to 90 atomic % of a second metal of titanium, vanadium, chromium, cobalt, nickel, zirconium, niobium, molybdenum, rhodium, palladium, hafnium, tantalum, tungsten, iridium, or platinum. The second metal is different from the first metal. The metalloid, the first metal, and the second metal account for at least 70 atomic % of the amorphous metal layer. Alternatively, two components of the metalloid, the first metal, and the second metal account for at least 70 atomic % of the amorphous metal layer. In each of the above ranges, e.g., for the metalloid the first metal, and/or the second metal, the lower end of the range can be modified independently to 10 atomic %, or 20 atomic %. Likewise, the upper end of these ranges can be modified independently to 85 atomic %, 80 atomic %, or 70 atomic %.

An amorphous metal layer 50 may be formed on the underlying material by, for example, sputtering, atomic layer deposition, chemical vapor deposition, electron beam evaporation, or thermal evaporation. In one example, applying an amorphous metal to a insulator includes mixing the metalloid, the first metal, and the second metal and sputtering the mixture onto the insulator. Sputtering can be carried out, for example, at 5 to 15 mTorr at a deposition rate of 5 to 10 nm/min with the target approximately 4 inches from a stationary substrate. Other deposition conditions may be used and other deposition rates can be achieved depending on variables such as target size, electrical power used, pressure, sputter gas, target to substrate spacing and a variety of other deposition system dependent variables.

An amorphous metal layer 50 may include, for example, from 5 atomic % to 85 atomic % of a third metal such as titanium, vanadium, chromium, cobalt, nickel, zirconium, niobium, molybdenum, rhodium, palladium, hafnium, tantalum, tungsten, iridium, or platinum. The third metal is different from the first metal and the second metal. A range of metalloid, first metal, second metal, and third metal can likewise be independently modified at the lower end to 10 atomic %, or 20 atomic %, and/or at the upper end to 80 atomic %, or 70 atomic %. In one example, the metalloid, the first metal, the second metal, and the third metal account for at least 80 atomic % of the amorphous metal layer.

With reference to the materials used to prepare the amorphous metal, three or four (or more) component amorphous mixtures can be prepared. As mentioned, one of the components can be a metalloid, and the other two or three components can be a Group IV, V, VI, IX, or X (4, 5, 6, 9, or 10) metal. These three or four component mixtures can be mixed in a manner and in quantities that the mixture is homogenous when applied. By using these three or four (or more) components in high enough concentrations, a "confusion" of sizes and properties disfavors the formation of lattice structures found more in single component or even two component mixtures. Selecting components with suitable size differentials can contribute to minimizing crystallization of the structure. For example, the amorphous metal may have an atomic dispersity of at least 12% between two or three of the elements. As used herein, "atomic dispersity" refers to the difference in size between the radii of two atoms. The atomic dispersity between components can contribute to the desirable properties of the amorphous metal, including thermal stability, oxidative stability, chemical stability, and surface roughness.

Figure 5:
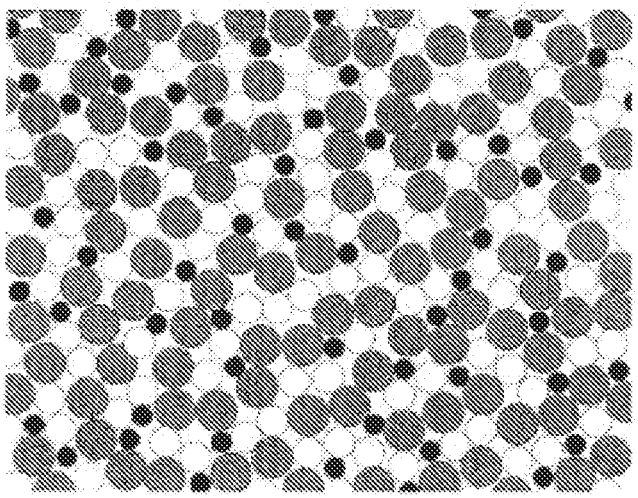
FIG. 5 is a schematic illustrating one example of the distribution of elements in an amorphous metal layer such as might be used in the printhead structures shown in FIGS. 1-4.
Figure 6:
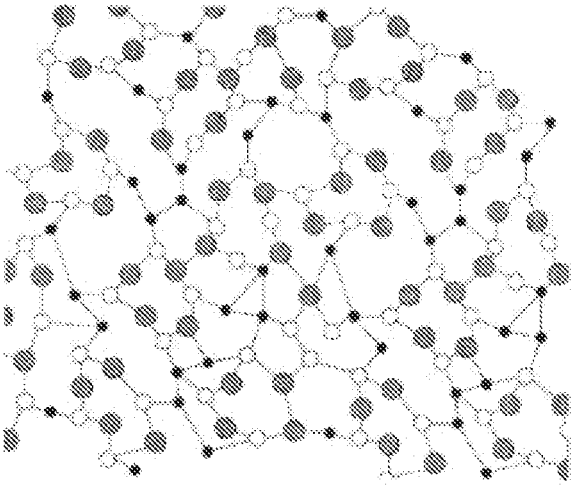
FIG. 6 is a schematic illustrating one example of the lattice structure in an amorphous metal layer such as might be used in the printhead structures shown in FIGS. 1-4.

FIG. 5 is a schematic illustrating one example of the distribution of elements in an amorphous metal layer such as might be used in a passivation structure 36 shown in FIGS. 1-4. FIG. 6 is a schematic illustrating one example of the lattice structure in an amorphous metal layer such as might be used in a passivation structure 36 shown in FIGS. 1-4. The amorphous metal layer can have a distribution of components with a desirable atomic dispersity with a smooth, grain-free non-crystalline lattice structure, as shown in FIGS. 5 and 6. FIGS. 5 and 6 are presented theoretically.

In one example, an amorphous metal layer can have a root mean square (RMS) roughness of less than 1 nm. In one example, an amorphous metal layer can have a thermal stability of at least 400° C. As used herein, "thermal stability" refers to the maximum temperature that the amorphous metal layer can be heated while maintaining an amorphous structure.

In one example, an amorphous metal layer can have an oxidation temperature of at least 700° C. As used herein, the oxidation temperature is the maximum temperature that the amorphous metal layer can withstand without failing from stress and embrittlement of the partially or completely oxidized layer. One method to measure the oxidation temperature is to heat the amorphous metal layer at progressively increasing temperatures in air until the layer cracks and flakes.

In one example, an amorphous metal layer can have an oxide growth rate of less than 0.05 nm/min. One method to measure the oxide growth rate is to heat the amorphous metal layer under air (20% oxygen) at a temperature of 300° C., measure the amount of oxidation using spectroscopic ellipsometry periodically, and average the data to provide a nm/min rate. Depending on the components and the method of manufacture, the amorphous thin metal film can have a wide range of electric resistivity, including ranging from 100μΩ·cm to 2000μΩ·cm.

In one example, an amorphous metal layer can have a negative heat of mixing and include a metalloid and two different metals selected from Periodic Table Groups IV, V, VI, IX, and X (4, 5, 6, 9, and 10). In one example, the amorphous metal can include a refractory metal selected from the group of titanium, vanadium, chromium, zirconium, niobium, molybdenum, rhodium, hafnium, tantalum, tungsten, and iridium. In one aspect, the first and/or second metal can be present in an amount ranging from 20 at % to 90 at %.

In one example, an amorphous metal layer can include a dopant. The dopant can include nitrogen, oxygen, and mixtures thereof. The dopant can be present in the amorphous metal in an amount ranging from 0.1 at % to 15 at %. Smaller amounts of dopants can also be present, but at such low concentrations, they would typically be considered impurities. Additionally, in one aspect, the amorphous metal can be devoid of aluminum, silver, and gold (except in trace amounts).

In one example, amorphous metal layers were prepared by DC and RF sputtering at 5 mTorr to 15 mTorr under argon, RF at 50 W to 100 W, and DC at 35 W to 55 W on to a silicon wafer. The resulting layer thickness was in the range of 100 nm to 500 nm. The specific components and amounts are listed in Tables 1 and 2.

TABLE 1

| Amorphous Thin Metal Protective Layers | Ratio (atomic %) | Ratio* (weight %) |
|---|---|---|
| TaNiSi | 40:40:20 | 71:23:6 |
| TaWSi | 40:40:20 | 48:49:4 |
| TaWSi | 30:50:20 | 36:61:4 |
| TaMoSi | 40:40:20 | 62:33:5 |
| TaPtSi | 40:40:20 | 46:50:4 |
| TaWNiSi | 35:35:10:20 | 45:46:4:4 |

*Weight ratio calculated from atomic % and rounded to the nearest integer

TABLE 2

| Amorphous Thin Metal Protective Layers | Ratio (atomic %) | Ratio* (weight %) |
|---|---|---|
| TaCoB | 60:40:30 | 85:14:1 |
| NbWB | 50:40:10 | 38:61:1 |
| MoPtC | 40:50:10 | 28:71:1 |
| WTiC | 30:40:30 | 71:25:5 |
| MoNiSi | 45:40:5 | 63:35:2 |
| TaWNiB | 35:35:10:20 | 47:47:4:2 |

*Weight ratio calculated from atomic % and rounded to the nearest integer

The amorphous metal layers of Table 1 were tested for electrical resistivity, thermal stability, chemical stability, oxidation temperature, oxide growth rate. The results are listed in Table 3. All of the layers had a surface RMS roughness of less than 1 nm. Surface RMS roughness was measured by atomic force microscopy (AFM). Electrical resistivity was measured by collinear four point probe for different deposition conditions providing the range listed in Table 3. Thermal stability was measured by sealing the amorphous metal layers in a quartz tube at approximately 50 mTorr and annealing up to the temperature reported with x-ray confirmation of the amorphous state, where the x-ray diffraction patterns showed evidence of Bragg reflections. Chemical stability was measured by immersing the amorphous metal layers in Hewlett-Packard Company commercial inks: CH602SERIES, HP Bonding Agent for Web Press; CH585SERIES, HP Bonding Agent for Web Press; and CH598SERIES, HP Black Pigment ink for Web Press, at 70° C. and checked at 2 and 4 weeks. Adequate chemical stability was present with the amorphous metal layers when there was no visual physical change or delamination, indicated by a "Yes" in Table 3. Oxidation temperature was measured as the maximum temperature that the amorphous metal layers can be exposed before failure due to stress creation and embrittlement of the partially or completely oxidized metal. Oxide growth rate was measured by heating the amorphous thin metal protective layers under air (20% oxygen) at a temperature of 300° C., measuring the amount of oxidation on the amorphous metal using spectroscopic ellipsometry periodically over a periods of 15, 30, 45, 60, 90, and 120 minutes, and then at 12 hours, and averaging the data to provide a nm/min rate.

TABLE 3

| Amorphous Thin Film Protective Layers | Ratio (at. %) | Electric Resistivity (μΩ-cm) | Thermal Stability (° C.) | Chemical Stability | Oxidation Temperature (° C.) | Oxide Growth Rate (nm/min) |
|---|---|---|---|---|---|---|
| TaNiSi | 40:40:20 | 230-440 | 500 | Yes | 700 | 0.035 |
| TaWSi | 40:40:20 | 210-255 | 900 | Yes | 1000 | 0.027* |
| TaWSi | 30:50:20 | 210-1500 | 900 | Yes | Not tested | 0.049* |
| TaMoSi | 40:40:20 | 165-1000 | 900 | Yes | Not tested | 0.132* |
| TaPtSi | 40:40:20 | 300 | 400 | Yes | Not tested | 0 |
| TaWNiSi | 35:35:10:20 | 200-440 | 800 | Yes | 800 | 0.039* |

*Showed evidence of passivation (decreased growth rate) after approx. 60 minutes "A" and "an" as used in the Claims means one or more.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

What is claimed is:

1. A printhead structure, comprising:

an ejector element;

a multi-layer insulator covering the ejector element; and an amorphous metal on the insulator, wherein the multi-layer insulator comprises:

a first insulator layer covering the ejector element; and a second insulator layer covering the first insulator layer, wherein the first insulator layer is thicker than the second insulator layer.

2. The structure of claim 1, where the multi-layer insulator includes only:

the first insulator layer on the ejector element; and the second insulator layer on the first insulator layer.

3. The structure of claim 2, where the amorphous metal on the insulator includes a single layer of amorphous metal on the second insulator.

4. The structure of claim 3, where:

the first and second insulator layers together are 50-150 nm thick; and the amorphous metal layer is 50-100 nm thick.

5. The structure of claim 4, where the second insulator layer is 5-20 nm thick.

6. The structure of claim 1, where the amorphous metal includes:

5 atomic % to 90 atomic % of a metalloid, the metalloid being carbon, silicon, or boron;

5 atomic % to 90 atomic % of a first metal, the first metal being titanium, vanadium, chromium, cobalt, nickel, zirconium, niobium, molybdenum, rhodium, palladium, hafnium, tantalum, tungsten, iridium, or platinum;

5 atomic % to 90 atomic % of a second metal different from the first metal, the second metal being titanium, vanadium, chromium, cobalt, nickel, zirconium, niobium, molybdenum, rhodium, palladium, hafnium, tantalum, tungsten, iridium, or platinum; and the metalloid, the first metal, and the second metal account for at least 70 atomic % of the amorphous metal.

7. The structure of claim 6, where the amorphous metal includes from 5 atomic % to 85 atomic % of a third metal different from the first and second metals, the third metal being titanium, vanadium, chromium, cobalt, nickel, zirconium, niobium, molybdenum, rhodium, palladium, hafnium, tantalum, tungsten, iridium, or platinum.

8. The structure of claim 6, where the amorphous metal has a surface RMS roughness less than 1 nm.

9. The printhead structure of claim 1, wherein the first insulator layer is a plasma enhance chemical vapor deposition layer and the second insulator layer is an atomic layer deposition layer.

10. A printhead structure, comprising:

an ejector element to eject a liquid from a dispensing chamber;

multiple passivation layers covering the ejector element; and an amorphous metal layer lining part of the dispensing chamber on an outermost passivation layer, wherein the multiple passivation layers comprise:

a first passivation layer covering the ejector element; and a second passivation layer covering the first passivation layer, wherein the first passivation layer is thicker than the second passivation layer.

11. The structure of claim 10, where:

the multiple passivation layers together are less than 150 nm thick; and the amorphous metal layer is less than 100 nm thick.

12. The structure of claim 11, where:

the outermost passivation layer includes hafnium oxide and is less than 20 nm thick; and the amorphous metal layer includes an alloy containing tantalum, tungsten and silicon and is less than 100 nm thick.

13. The printhead structure of claim 10, wherein the first passivation layer is a plasma enhance chemical vapor deposition layer and the second passivation layer is an atomic layer deposition layer.

14. A printhead structure, comprising:

a resistor;

a single first insulator layer on the resistor;

a single second insulator layer on the first insulator layer; and a single amorphous metal layer on the second insulator layer, wherein the single first insulator layer is thicker than the single second insulator layer.

15. The structure of claim 14, where:

the first insulator layer is a layer of silicon nitride;

the second insulator layer is a layer of hafnium oxide; and the amorphous metal layer is a layer of an alloy of tantalum, tungsten and silicon.

16. The printhead structure of claim 1, wherein the single first insulator layer is a plasma enhance chemical vapor deposition layer and the single second insulator layer is an atomic layer deposition layer.

* * * * *